US011354964B2

(12) United States Patent
Yagi et al.

(10) Patent No.: US 11,354,964 B2
(45) Date of Patent: Jun. 7, 2022

(54) MONEY PROCESSING MACHINE

(71) Applicant: GLORY LTD., Himeji (JP)

(72) Inventors: Yuki Yagi, Himeji (JP); Hisashi Ishitobi, Himeji (JP); Akira Okuda, Himeji (JP)

(73) Assignee: GLORY LTD., Himeji (JP)

( * ) Notice: Subject to any disclaimer, the term of this patent is extended or adjusted under 35 U.S.C. 154(b) by 0 days.

(21) Appl. No.: 16/854,083

(22) Filed: Apr. 21, 2020

(65) Prior Publication Data

US 2020/0342705 A1 Oct. 29, 2020

(30) Foreign Application Priority Data

Apr. 26, 2019 (JP) ..... JP2019-85737

(51) Int. Cl.

| | |
|---|---|
| ***G07D 11/40*** | (2019.01) |
| ***G07D 11/16*** | (2019.01) |
| ***G07D 11/14*** | (2019.01) |
| ***G07D 11/00*** | (2019.01) |

(52) U.S. Cl.

CPC ..... *G07D 11/40* (2019.01); *G07D 11/009* (2013.01); *G07D 11/14* (2019.01); *G07D 11/16* (2019.01)

(58) Field of Classification Search

CPC ..... G07D 11/40; G07D 11/16; G07D 11/14; G07D 11/009

See application file for complete search history.

(56) References Cited

U.S. PATENT DOCUMENTS

| | | | | |
|---|---|---|---|---|
| 6,296,185 | B1 * | 10/2001 | Dejaeger | A47F 9/046 235/383 |
| 2010/0106292 | A1 | 4/2010 | Buschmann et al. | |
| 2011/0057036 | A1 | 3/2011 | Matsuhisa et al. | |
| 2014/0060997 | A1 | 3/2014 | Doi et al. | |
| 2017/0256114 | A1 * | 9/2017 | Shimura | G06Q 20/206 |
| 2018/0240310 | A1 | 8/2018 | Watanabe et al. | |

FOREIGN PATENT DOCUMENTS

| | | |
|---|---|---|
| JP | 5902667 B2 | 4/2016 |
| JP | 2018-133049 A | 8/2018 |

OTHER PUBLICATIONS

Extended European Search Report, Application No. 20170847.6, dated Oct. 2, 2020, 16 pages.

* cited by examiner

*Primary Examiner* — Laura A Gudorf
(74) *Attorney, Agent, or Firm* — Foley & Lardner LLP

(57) ABSTRACT

Provided is a small-sized money processing machine that is easy to use in a store. A money processing machine used for settlement of a transaction performed in a store, includes: a banknote processing unit that performs depositing and dispensing of banknotes; a coin processing unit that performs depositing and dispensing of coins; and an accommodation unit that accommodates components to be connected to at least one of the banknote processing unit and the coin processing unit. The banknote processing unit, the coin processing unit, and the accommodation unit are disposed in a housing so as to be vertically aligned.

18 Claims, 8 Drawing Sheets

MONEY PROCESSING MACHINE

BACKGROUND OF THE INVENTION

Field of the Invention

The present invention relates to a money processing machine for processing banknotes and coins.

Description of the Background Art

Conventionally, money processing machines for processing banknotes and coins have been used. For example, Japanese Patent No. 5902667 discloses a money processing machine that performs depositing and dispensing of money. This money processing machine includes a banknote processing unit and a coin processing unit installed side by side along the width direction (left-right direction) of the machine. The height, width, and depth of the banknote processing unit are substantially the same as those of the coin processing unit so that the two units arranged in the left-right direction can be easily used.

A user of the money processing machine deposits and dispenses banknotes with the banknote processing unit, and deposits and dispenses coins with the coin processing unit. For example, the money processing machine is installed in a store and is used for settlement of the prices of items to be purchased by a customer in the store. The money processing machine performs depositing, i.e., recognizes and counts banknotes and coins that the customer has paid for the commodities and stores the banknotes and coins in the machine. When change has to be returned to the customer, the money processing machine performs dispensing, i.e., dispenses banknotes and coins, stored in the machine, being appropriately combined as change.

SUMMARY OF THE INVENTION

In the conventional art, however, user's requests are not sufficiently fulfilled in some cases. For example, there are cases where a user requires a small-sized money processing machine whose dimension in the width direction is reduced according to the scale and layout of a store.

The present invention is made in view of the problem of the conventional art, and an object of the present invention is to provide a small-sized money processing machine.

In order to solve the above-described problems and achieve the object, a money processing machine according to one aspect of the present invention is used for settlement of a transaction performed in a store. The machine includes: a banknote processing unit configured to perform depositing and dispensing of banknotes; a coin processing unit configured to perform depositing and dispensing of coins; and an accommodation unit configured to accommodate components to be connected to at least one of the banknote processing unit and the coin processing unit. The banknote processing unit, the coin processing unit, and the accommodation unit are disposed in a housing so as to be vertically aligned.

The above and other objects, features, advantages and technical and industrial significance of this invention will be better understood by reading the following detailed description of presently preferred embodiments of the invention, when considered in connection with the accompanying drawings.

DESCRIPTION OF THE PREFERRED EMBODIMENTS

Hereinafter, an embodiment of a money processing machine according to the present invention will be described with reference to the accompanying drawings. The money processing machine is used for depositing and dispensing money (banknotes and coins) in various places. In the present embodiment, the money processing machine installed in a store will be described as an example.

The money processing machine according to the present embodiment is used for settlement of the monetary amount of a transaction performed between a customer and the store. For example, the customer, who purchases items in the store, inserts banknotes and coins into the money processing machine to pay for the total price of the items, and receives change according to need.

Figure 1:
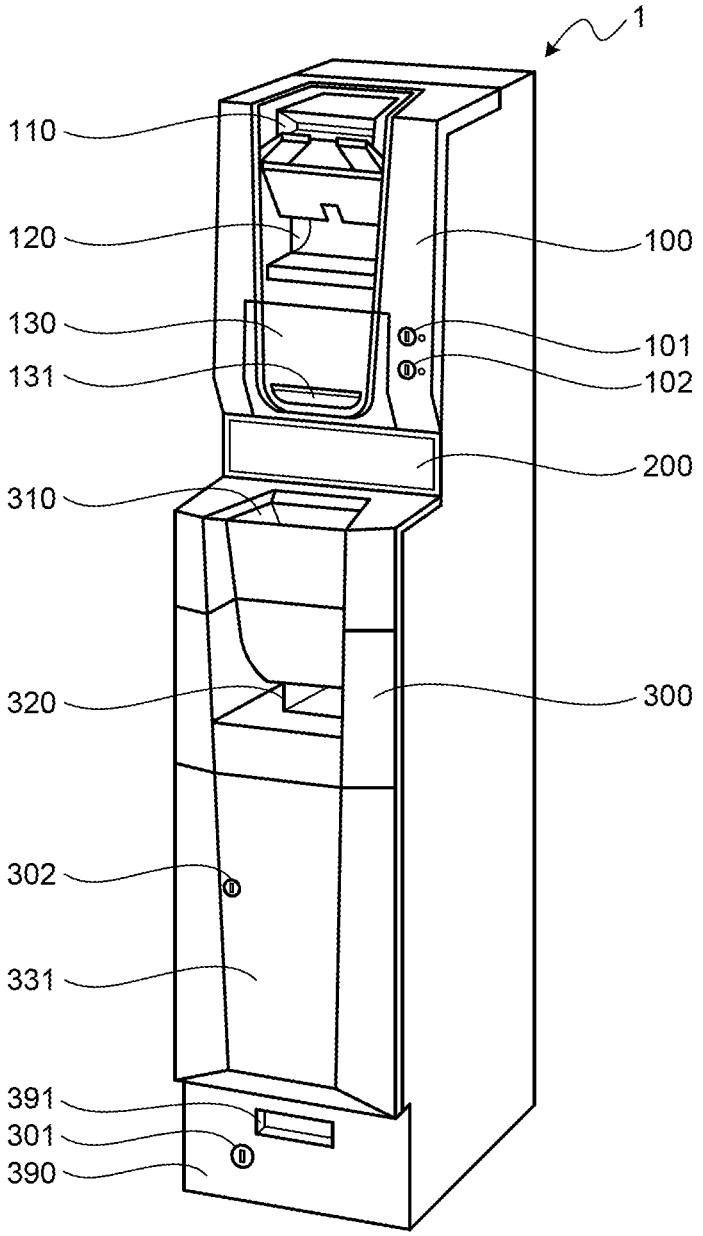
FIG. 1 shows an external appearance of a money processing machine according to an embodiment.
Figure 2:
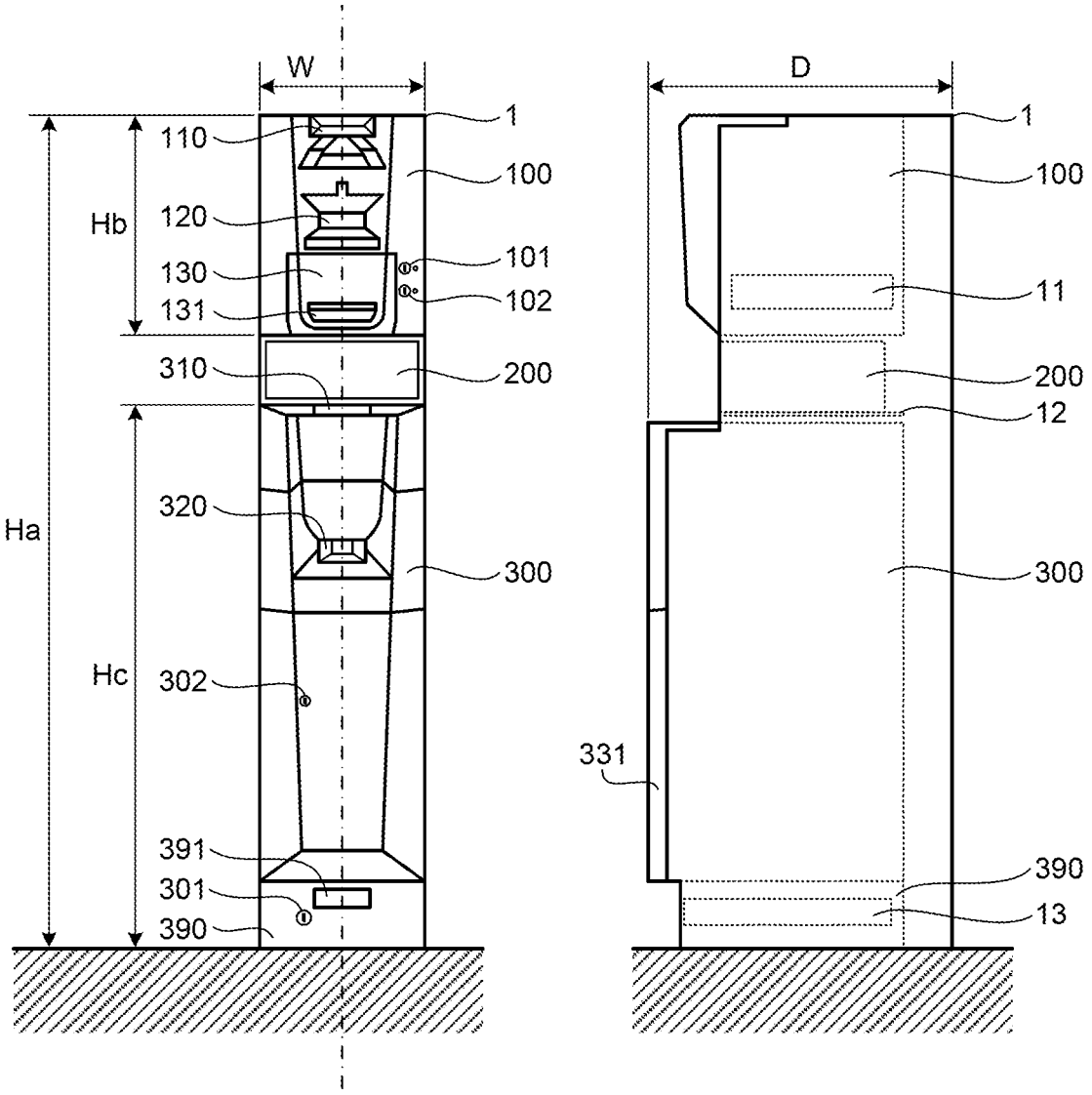
FIG. 2 shows a front surface and a side surface of the money processing machine.
Figure 3:
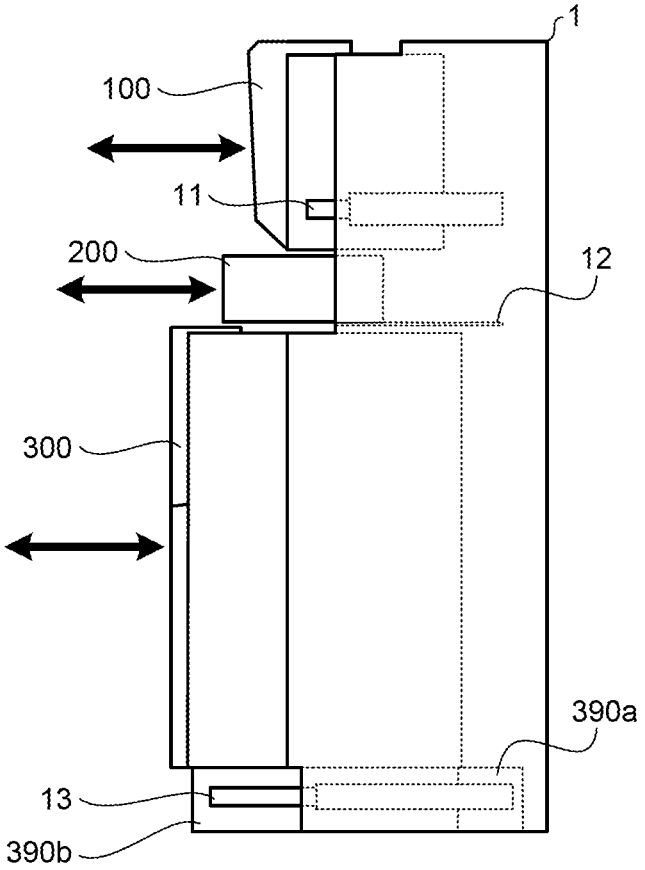
FIG. 3 illustrates a method of drawing a banknote processing unit, a power supply/communication unit, and a coin processing unit which are components of the money processing machine.

FIG. 1 shows an external appearance of a money processing machine 1 according to the present embodiment. FIG. 2 shows a front surface and a side surface of the money processing machine 1. FIG. 3 illustrates a method of drawing a banknote processing unit 100, a power supply/communication unit 200, and a coin processing unit 300 which are components of the money processing machine 1.

The money processing machine 1 includes the banknote processing unit 100, the power supply/communication unit 200, and the coin processing unit 300. The banknote processing unit 100, the power supply/communication unit 200, and the coin processing unit 300 are aligned in the up-down direction in a housing of the money processing machine 1. Specifically, the coin processing unit 300 is disposed at the bottom of the housing, and the banknote processing unit 100 is disposed at the top of the housing. The power supply/communication unit 200 is disposed between the banknote processing unit 100 and the coin processing unit 300. That is, the banknote processing unit 100, the power supply/communication unit 200, and the coin processing unit 300 are vertically arranged in a line.

The banknote processing unit 100, the power supply/communication unit 200, and the coin processing unit 300 are individually unitized. A store clerk of the store can draw each unit frontward from the front surface side of the money processing machine 1, and expose, to the outside, the components of the unit which are usually inside the housing of the money processing machine 1. For example, each unit is drawn out from the money processing machine 1 when maintenance and/or inspection are required.

The side surfaces, on the left and right outer sides, of the banknote processing unit 100 are connected to the side surfaces, on the left and right inner sides, of the housing of the money processing machine 1 by slide rails 11 as shown in FIG. 2. Thus, the banknote processing unit 100 is slidable in the front-rear direction with respect to the money processing machine 1 as shown by an arrow in FIG. 3. As shown in FIG. 1 and FIG. 2, a keyhole 101 and a handle 131 are disposed at the front surface of the banknote processing unit 100. The keyhole 101 is used for locking and unlocking a lock mechanism for locking the banknote processing unit 100 with the housing of the money processing machine 1. The lock mechanism is usually locked by the store clerk to lock the banknote processing unit 100 so as not to be drawn out from the money processing machine 1. The store clerk can insert a key into the keyhole 101 and unlock the lock mechanism according to need, and draw the banknote processing unit 100 frontward with his/her hand grabbing the handle 131.

The power supply/communication unit 200 is placed on a support member 12 fixed in the housing of the money processing machine 1 as shown in FIG. 2. The power supply/communication unit 200 is slidable on the support member 12 as shown by an arrow in FIG. 3. That is, the power supply/communication unit 200 is slidable in the front-rear direction with respect to the money processing machine 1.

The coin processing unit 300 is placed on a base unit 390 fixed to the bottom surface of the housing of the money processing machine 1. As shown in FIG. 3, the base unit 390 includes a fixed part 390*a*, a movable part 390*b*, and slide rails 13. The fixed part 390*a* is fixed to the bottom surface of the housing of the money processing machine 1. The side surfaces, on the left and right outer sides, of the movable part 390*b* are connected to the side surfaces, on the left and right inner sides, of the fixed part 390*a* by the slide rails 13 as shown in FIG. 2. The movable part 390*b* is slidable in the front-rear direction with respect to the fixed part 390*a* fixed to the money processing machine 1. The coin processing unit 300 is fixed onto the movable part 390*b*. Thus, the coin processing unit 300 is slidable in the front-rear direction with respect to the money processing machine 1, together with the movable part 390*b*, as shown by an arrow in FIG. 3. As shown in FIG. 1 and FIG. 2, a keyhole 301 and a handle 391 are disposed at a lower part on the front surface of the coin processing unit 300. The keyhole 301 is used for locking and unlocking a lock mechanism for locking the movable part 390*b* with respect to the fixed part 390*a*. The lock mechanism is usually locked by the store clerk to lock the coin processing unit 300 fixed to the movable part 390*b* so as not to be drawn out from the money processing machine 1. The store clerk can insert a key into the keyhole 301 and unlock the lock mechanism according to need, and draw the coin processing unit 300 frontward together with the movable part 390*b* with his/her hand grabbing the handle 391 of the movable part 390*b*.

The slide rails 11, 13 each have stoppers. When the banknote processing unit 100, the power supply/communication unit 200, and the coin processing unit 300 are drawn frontward from the front surface side of the money processing machine 1 as shown in FIG. 3, these units are stopped at predetermined positions by the stoppers of the slide rails 11, 13. Thus, when the store clerk draws the banknote processing unit 100 frontward, the unit 100 is prevented from slipping out of the money processing machine 1. Likewise, when the store clerk draws the coin processing unit 300 frontward, the unit 300 is prevented from unnecessarily protruding frontward.

The stoppers of the slide rails 11 and 13 can be released. The store clerk can release the stoppers according to need to dismount the banknote processing unit 100 and the coin processing unit 300 from the money processing machine 1. For example, the store clerk releases the stopper of the slide rail 11, dismounts the banknote processing unit 100, and mounts another banknote processing unit 100, thereby exchanging the banknote processing units 100. Likewise, the store clerk can replace the coin processing unit 300 with another unit. Also, the store clerk can replace the power supply/communication unit 200 placed on the support member 12 with another unit, like the banknote processing unit 100 and the coin processing unit 300.

For example, when an improved version of any of the banknote processing unit 100, the power supply/communication unit 200, and the coin processing unit 300 becomes available, the store clerk can dismount the unit being used to replace it with a new unit.

For example, when a failure occurs in any of the banknote processing unit 100, the power supply/communication unit 200, and the coin processing unit 300, the store clerk can draw the failed unit frontward and repair the unit. Alternatively, the store clerk can dismount the failed unit and mount a unit that normally operates, and repair the dismounted unit while continuously using the money processing machine 1.

As shown in FIG. 1 and FIG. 2, the banknote processing unit 100 has a depositing unit 110 and a dispensing unit 120 on the front surface side. The dispensing unit 120 is disposed beneath the depositing unit 110. The depositing unit 110 has an inlet, which can receive a plurality of banknotes to be deposited, at an upper end of the front surface of the banknote processing unit 100. At least a part of the banknote inlet is present on the front surface of the banknote processing unit 100. The dispensing unit 120 has an outlet, which can discharge a plurality of banknotes to be dispensed, at the front surface of the banknote processing unit 100.

The banknote processing unit 100 has a cassette 130 on the front surface side. The cassette 130 has a box-shaped storage unit inside the banknote processing unit 100 and stores banknotes therein. The cassette 130 is detachably mounted to the banknote processing unit 100. The cassette 130 mounted to the banknote processing unit 100 has a front surface with a handle 131 being exposed to the outside as shown in FIG. 1.

A keyhole 102 is disposed at the front surface of the banknote processing unit 100. The keyhole 102 is used for locking and unlocking a lock mechanism for locking the cassette 130 with the banknote processing unit 100. The lock mechanism is usually locked by the store clerk to lock the cassette 130 so as not to be taken out from the banknote processing unit 100. The store clerk can insert a key into the keyhole 102 and unlock the lock mechanism according to need, and take out the cassette 130 from the front surface of the machine 1 with his/her hand grabbing the handle 131. For example, the store clerk takes out the cassette 130 in which banknotes are being stored, from the banknote processing unit 100, and collects the banknotes together with the cassette.

The handle 131 disposed at the front surface of the cassette 130 is used for both taking out the cassette 130 from the banknote processing unit 100 and drawing the banknote processing unit 100 from the money processing machine 1. The store clerk unlocks the lock mechanism corresponding to the keyhole 102 with the lock mechanism corresponding to the keyhole 101 being locked, grabs the handle 131, and takes out the cassette 130 from the banknote processing unit 100. Meanwhile, the store clerk unlocks the lock mechanism corresponding to the keyhole 101 with the lock mechanism corresponding to the keyhole 102 being locked, grabs the handle 131, and draws the banknote processing unit 100 frontward from the money processing machine 1.

As shown in FIG. 1 and FIG. 2, the coin processing unit 300 has a depositing unit 310 and a dispensing unit 320 on the front surface side. The depositing unit 310 is disposed at an upper end of the front surface of the coin processing unit 300. The dispensing unit 320 is disposed beneath the depositing unit 310 on the front surface side of the coin processing unit 300. The depositing unit 310 has an inlet, which can receive a plurality of coins to be deposited, at the front end of the upper surface of the coin processing unit 300. At least a part of the coin inlet is present on the upper surface of the coin processing unit 300. The dispensing unit 320 has an outlet, which can discharge a plurality of coins to be dispensed, at the front surface of the coin processing unit 300.

Figure 8:
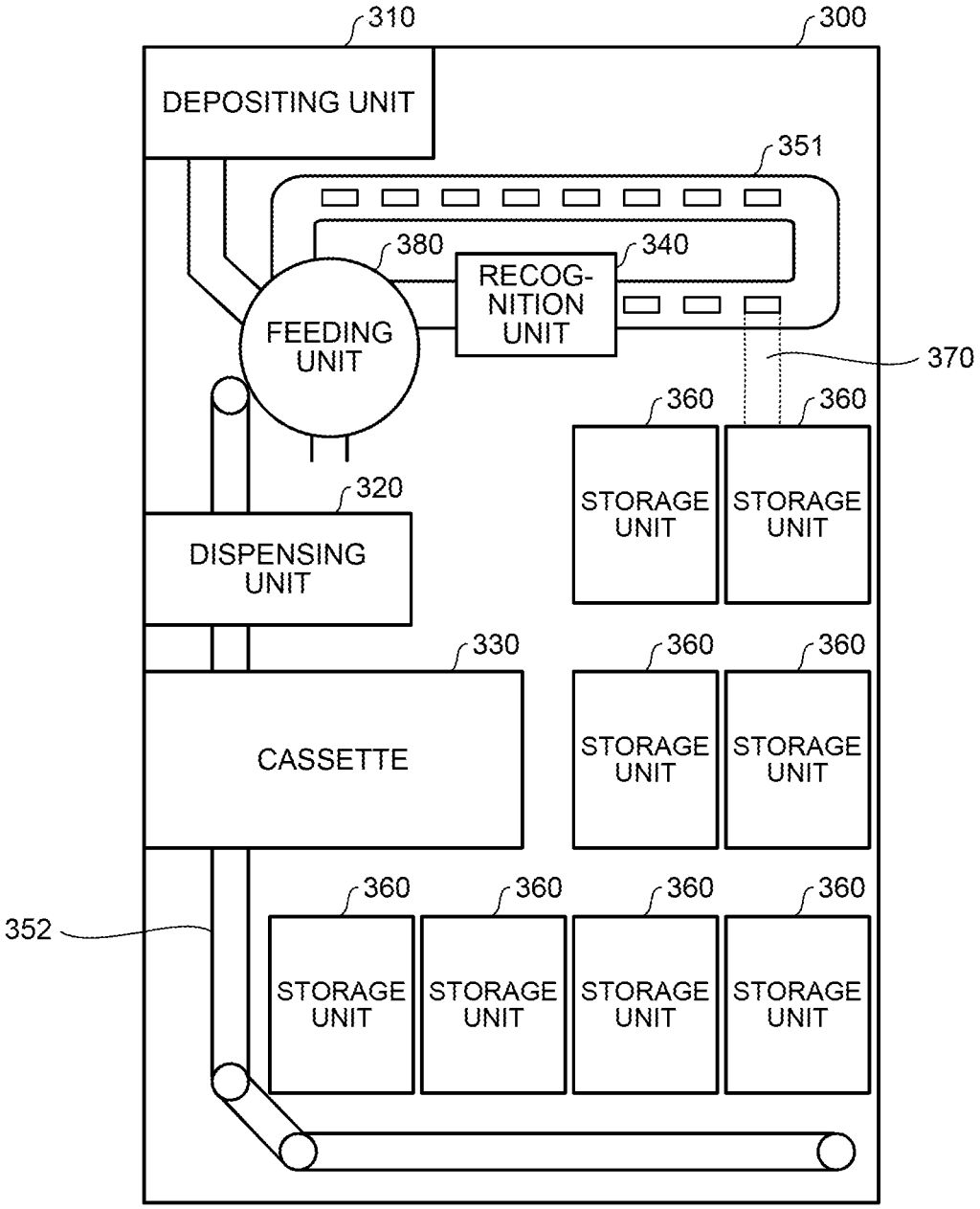
FIG. 8 schematically shows an internal structure of the coin processing unit.

Like the banknote processing unit 100, the coin processing unit 300 has a cassette 330 that is detachable from the front surface side (see FIG. 8). The cassette 330 has a storage unit that stores coins therein. The cassette 330 is inside the coin processing unit 300. The cassette 330 mounted to the coin processing unit 300 is inside a cover 331 shown in FIG. 1.

The cover 331 of the coin processing unit 300 has a keyhole 302. The keyhole 302 is used for locking and unlocking a lock mechanism for locking the cover 331 with the coin processing unit 300. The lock mechanism is usually locked by the store clerk to lock the cover 331 so as not to be opened. The store clerk can insert a key into the keyhole 302 and unlock the lock mechanism according to need, and open the cover 331 to take out the cassette 330. For example, the store clerk takes out the cassette 330 in which coins are being stored, from the coin processing unit 300, and collects the coins together with the cassette 330.

As shown in FIG. 2, the money processing machine 1, in a plan view, has the depositing unit 110 and the dispensing unit 120 for banknotes and the depositing unit 310 and the dispensing unit 320 for coins, arranged in a line along the up-down direction, on a center line in the width direction (left-right direction) of the machine 1. The banknote inlet, the banknote outlet, the coin inlet, and the coin outlet are located such that at least parts thereof overlap each other in the width direction of the machine 1. That is, as viewed from the front surface side of the money processing machine 1, the banknote inlet, the banknote outlet, the coin inlet, and the coin outlet are located such that at least parts thereof overlap the same vertical line. For example, the center of the banknote inlet, the center of the banknote outlet, the center of the coin inlet, and the center of the coin outlet match the center of the money processing machine 1 in the width direction. In addition, the front surface of the money processing machine 1 has an appearance that is substantially symmetrical with respect to the center line of the machine 1 in the width direction. The left and right side surfaces and the rear surface of the money processing machine 1 each form a vertical surface, and the upper surface thereof forms a plane surface. This allows actions regarding depositing and dispensing of banknotes and coins to be easily performed even when the right side surface of the money processing machine 1 abuts on a wall surface or another machine of the store and/or the left side surface of the money processing machine 1 abuts on a wall surface or another machine of the store.

The money processing machine 1 has a vertically elongated shape as shown in FIG. 2, with a width W ranging from 250 to 300 mm, a height Ha ranging from 1200 to 1250 mm, and a depth D ranging from 650 to 700 mm. The money processing machine 1 has a small footprint and therefore can be installed in a narrow space. The width W of the money processing machine 1 is ¼ or less of the height Ha thereof. The money processing machine 1 can process both banknotes and coins while being installable in a narrower space as compared to the conventional machines. In addition, a height Hb of the banknote processing unit 100 is about 300 mm while a height Hc of the coin processing unit 300 shown in FIG. 2 is about 800 mm. Thus, the height Hb of the banknote processing unit 100 is ½ or less of the height Hc of the coin processing unit 300.

Figure 4:
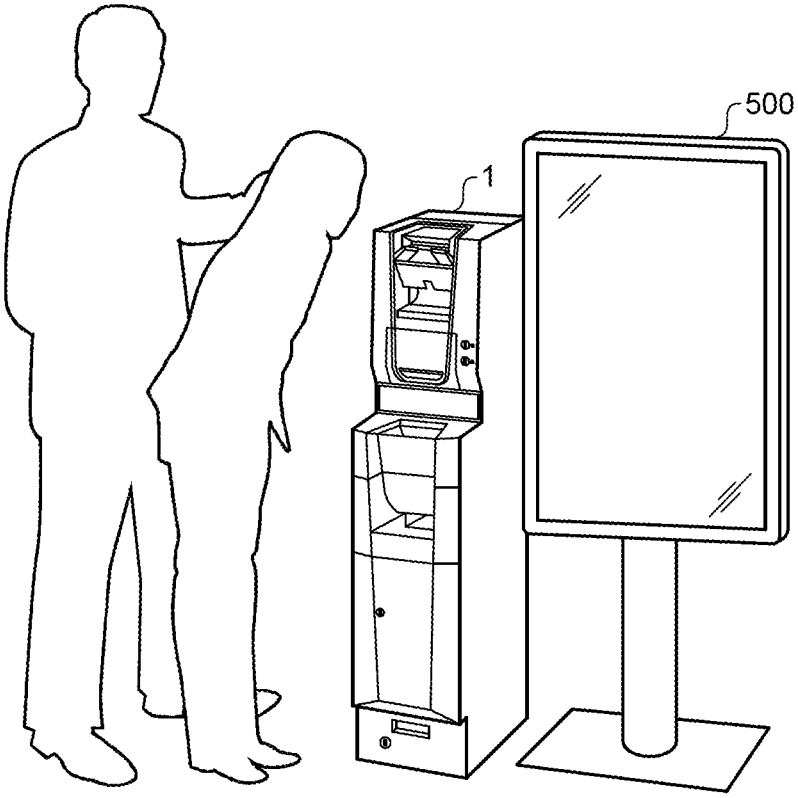
FIG. 4 shows a usage example of the money processing machine installed in a store.
Figure 5:
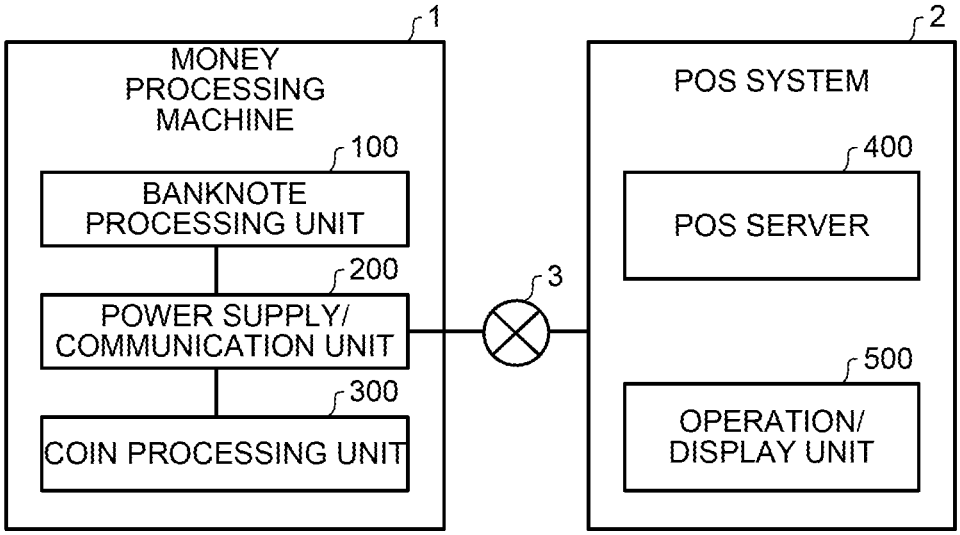
FIG. 5 is a block diagram showing an example of the money processing machine connected to a POS system.

FIG. 4 shows a usage example of the money processing machine 1 installed in a store. The money processing machine 1 is used while being connected to a POS system, for example. FIG. 5 is a block diagram showing an example of the money processing machine 1 connected to a POS system 2. The money processing machine 1 is connected to the POS system 2 via a network 3, for example.

As shown in FIG. 5, the POS system 2 includes a POS server 400 and an operation/display unit 500. The POS server 400 manages information of items in the store, and information of transactions performed in the store. The operation/display unit 500 is used for inputting information of items to be purchased by a customer. For example, as shown in FIG. 4, a large touch-panel type liquid crystal display device is used as the operation/display unit 500 of the POS system 2. The customer selects items to purchase while checking the information displayed on the screen of the operation/display unit 500. When the customer has finished selecting the items to purchase, the total price to be paid by the customer, i.e., the monetary amount of a transaction, is calculated based on the information managed in the POS server 400, and is inputted to the money processing machine 1. Upon receiving the monetary amount of transaction from the POS system 2, the money processing machine 1 performs depositing, i.e., receives cash, corresponding to the monetary amount of transaction, deposited by the customer. The money processing machine 1 performs dispensing, i.e., dispenses change according to need.

The money processing machine 1 has a structure in consideration of the average height of adults to avoid customers from having an oppressing feeling when the machine 1 is installed in the store. For example, as shown in FIG. 4, the height (height Ha in FIG. 2) of the money processing machine 1 is smaller than the average height of adults. In addition, among the inlets and the outlets disposed at the front surface of the machine 1, even the uppermost banknote inlet is disposed at a position leveled with or lower than the eyes of many adult customers, and the lowermost coin outlet is disposed at a position higher than the knees of many adult customers. This enables the customers to easily perform depositing and dispensing of banknotes and coins.

As shown in the side views of FIG. 1 and FIG. 2, the front surface of the banknote processing unit 100 and the front surface of the power supply/communication unit 200 are retracted toward the rear surface of the machine 1 with respect to the front surface of the coin processing unit 300. The inlet of the depositing unit 310 into which coins are deposited is disposed at a position between the front surface of the coin processing unit 300 and the front surface of the power supply/communication unit 200 in the depth direction of the machine 1. For example, the coin inlet is disposed at the front end of the upper surface of the coin processing unit 300. As shown in FIG. 4, when a customer standing in front of the money processing machine 1 looks down the coin processing unit 300, the customer can easily check the inside of the coin inlet disposed at the front end of the upper surface of the coin processing unit 300.

Figure 6:
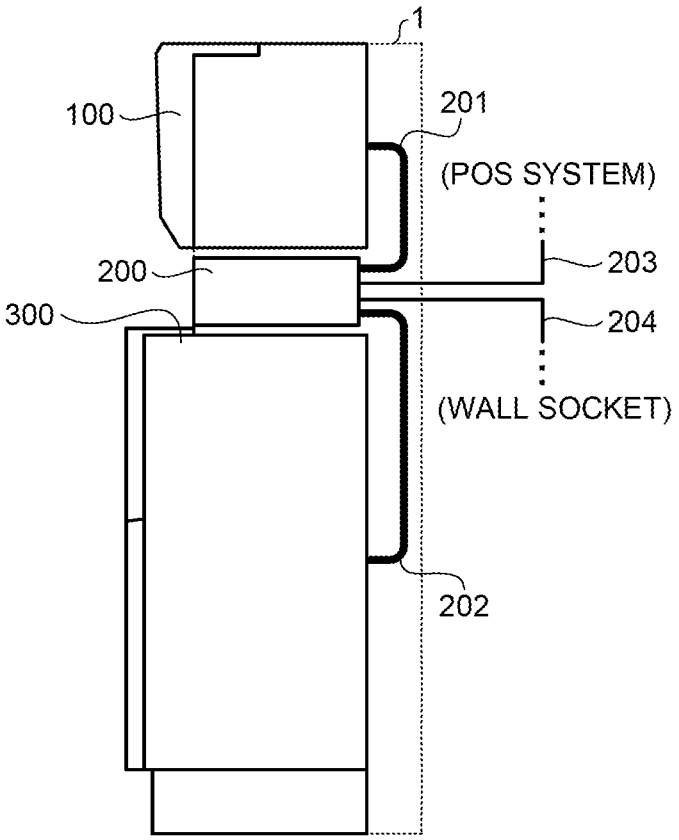
FIG. 6 shows an example of connection between the power supply/communication unit and each of the banknote processing unit and the coin processing unit.

As shown in FIG. 5, the banknote processing unit 100 and the coin processing unit 300 are connected to the power supply/communication unit 200. FIG. 6 shows an example of connection between the power supply/communication unit 200 and each of the banknote processing unit 100 and the coin processing unit 300. In FIG. 6, the housing of the money processing machine 1 is indicated by a broken line, while the banknote processing unit 100, the power supply/communication unit 200, and the coin processing unit 300 are indicated by solid lines.

As shown in FIG. 6, the banknote processing unit 100 and the power supply/communication unit 200 are connected to each other by a cable 201 in the housing of the money processing machine 1. The cable 201 is formed by bundling a plurality of cables together. For example, the cable 201 includes a power supply cable through which power is supplied from the power supply/communication unit 200 to the banknote processing unit 100, and a communication cable through which information is exchanged between the power supply/communication unit 200 and the banknote processing unit 100. Likewise, the coin processing unit 300 and the power supply/communication unit 200 are connected to each other by a cable 202 in the housing of the money processing machine 1. The cable 202 is formed by bundling a plurality of cables together. For example, the cable 202 includes a power supply cable through which power is supplied from the power supply/communication unit 200 to the coin processing unit 300, and a communication cable through which information is exchanged between the power supply/communication unit 200 and the coin processing unit 300. Each of the cables 201 and 202 has connection terminals (connection interface) at both ends. The units connected to each other by the cable 201 or 202 are provided with connection ports (connection interface) corresponding to the connection terminals of the cable 201 or 202. When the connection terminals at the both ends of the cable 201 or 202 are respectively connected to the connection ports of two different units, the two units are connected to each other by the cable 201 or 202 including the power supply cable and the communication cable.

The power supply/communication unit 200 includes a power supply unit and a communication unit. The power supply unit includes components such as a power supply board for supply of power. The communication unit includes components such as a communication board for communication. The communication unit is connected to the power supply unit, and is operated with power supplied from the power supply unit. The power supply/communication unit 200, i.e., the power supply unit and the communication unit, are housed in a box-shaped accommodation unit.

The power supply unit supplies power to a control board of the banknote processing unit 100 and a control board of the coin processing unit 300 through the cables 201, 202, respectively. The power supply unit is provided with a switch for switching between a state where power is supplied to the control boards of the banknote processing unit 100 and the coin processing unit 300, and a state where power is not supplied thereto.

Although schematically shown in FIG. 6, each of the cables 201 and 202, which connects two of the three units, i.e., the banknote processing unit 100, the power supply/communication unit 200, and the coin processing unit 300, is actually sufficiently longer than the distance between the two units. While the two units are connected to each other by the cable 201 or 202, one of the units can be drawn frontward as shown in FIG. 3. The store clerk can draw each unit frontward from the front surface side of the money processing machine 1, and disconnect the cable 201 or 202 connected to the rear surface of the unit.

Each of the cables 201, 202 including the power supply cable and the communication cable is covered with a protection member made of resin to prevent the cable from being damaged due to contact with other components inside the machine 1 when the unit is drawn out. A plurality of cables including the power supply cable and the communication cable are bundled together by the protection member to prevent the cables from being damaged and cut, thereby forming the cable 201, 202. For example, a spiral tube, a corrugate tube, a cable chain (drag chain cable carrier), etc., are used as the protection member.

As shown in FIG. 6, the communication unit of the power supply/communication unit 200 is connected to the POS system 2 by a communication cable 203. The communication unit exchanges information with the POS system 2 via the communication cable 203. The power supply unit of the power supply/communication unit 200 is connected to a power supply cable 204 for receiving power supplied from an external AC power source (outlet). The communication cable 203 and the power supply cable 204 extend outward from the rear surface of the housing of the money processing machine 1.

When an attachment plug of the power supply cable 204 is plugged into a wall socket in the store, power is supplied to the power supply unit of the power supply/communication unit 200. The power supply unit, which is supplied with power from the wall socket, supplies power to the banknote processing unit 100 through the cable 201, and supplies power to the coin processing unit 300 through the cable 202. In this state, when the store clerk opens the cover of the power supply/communication unit 200 at the front surface of the money processing machine 1 and turns on a switch of the money processing machine 1, both the banknote processing unit 100 and the coin processing unit 300 are activated. Thus, the banknote processing unit 100 becomes able to process banknotes, and the coin processing unit 300 becomes able to process coins.

When a terminal of the communication cable 203 is inserted to a port for the network 3 provided in the store, the communication unit of the power supply/communication unit 200 is communicably connected to the POS system 2 via the network 3 as shown in FIG. 5. The banknote processing unit 100 can exchange information with the POS system 2 via the communication unit connected thereto through the cable 201. Likewise, the coin processing unit 300 can exchange information with the POS system 2 via the communication unit connected thereto through the cable 202. That is, the communication unit establishes communication of the banknote processing unit 100 and the coin processing unit 300 with an external device via the network 3. Thus, the money processing machine 1 can receive the monetary amount of transaction that is calculated by the POS system 2 when transaction is performed between the store and the customer. Then, the money processing machine 1 can receive cash, deposited by the customer, corresponding to the monetary amount of transaction, and dispense change according to need, through the banknote processing unit 100 and the coin processing unit 300.

The money processing machine 1 performs depositing and dispensing of banknotes by using the banknote processing unit 100, and performs depositing and dispensing of coins by using the coin processing unit 300. Specifically, the money processing machine 1 receives, by the banknote processing unit 100, banknotes among the cash paid by the customer to the store at the transaction, and stores the banknotes therein. The money processing machine 1 receives, by the coin processing unit 300, coins among the cash paid by the customer to the store at the transaction, and stores the coins therein. When change has to be returned to the customer, the money processing machine 1 feeds out banknotes for the change from the banknote processing unit 100, and feeds out coins for the change from the coin processing unit 300.

Figure 7:
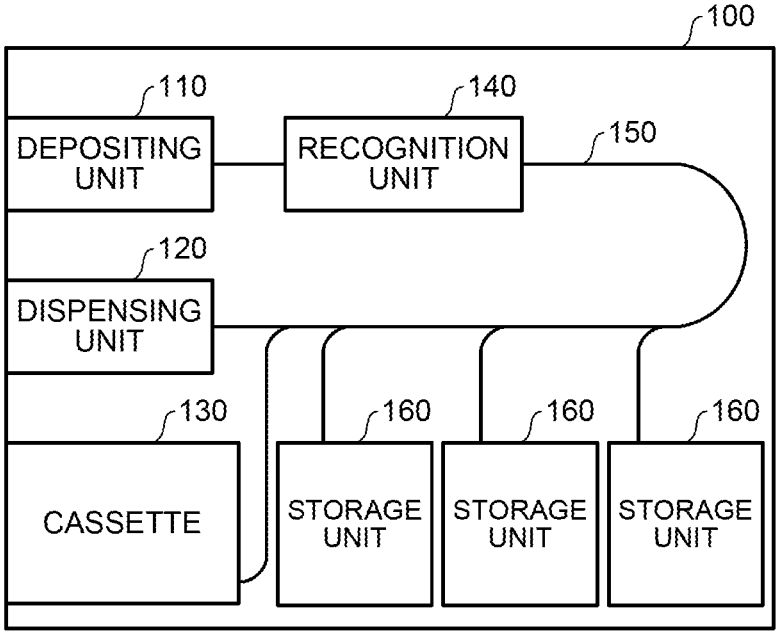
FIG. 7 schematically shows an internal structure of the banknote processing unit.

FIG. 7 schematically shows an internal structure of the banknote processing unit 100. As shown in FIG. 7, the banknote processing unit 100 includes the depositing unit 110, the dispensing unit 120, the cassette 130, a recognition unit 140, a transport unit 150, and a plurality of storage units 160.

For example, the banknote processing unit 100 includes three storage units 160. As shown in FIG. 3, the store clerk can draw the banknote processing unit 100 frontward from the front surface side of the money processing machine 1 to expose the components shown in FIG. 7 outside the housing of the money processing machine 1. For example, when a banknote is jammed in a storage unit 160 or a transport path of the transport unit 150, the store clerk draws the banknote processing unit 100 from the money processing machine 1, and removes the jammed banknote.

During depositing when a customer pays cash to the store, the depositing unit 110 receives, at the inlet, banknotes paid by the customer, and feeds the banknotes one by one into the banknote processing unit 100. The transport unit 150 transports the banknotes fed out from the depositing unit 110 along the transport path. The recognition unit 140 recognizes and counts the banknotes transported along the transport path. The recognition unit 140 recognizes, for example, denomination, fitness, and authenticity of each banknote. Based on the recognition result, the transport unit 150 transports the banknote to any of the dispensing unit 120, the cassette 130, and the storage units 160.

The store clerk can previously set the kinds of banknotes to be stored in the respective storage units 160. For example, one or a plurality of denominations of banknotes to be stored are set on each storage unit 160. A banknote which can be deposited is stored in the corresponding storage unit 160, according to the recognition result of the recognition unit 140. When the storage unit 160 corresponding to the banknote is full, the banknote is stored in the cassette 130. A banknote which cannot be deposited is discharged from the dispensing unit 120 as a rejected banknote. For example, a banknote which cannot be recognized by the recognition unit 140 and a banknote which is recognized as a counterfeit note by the recognition unit 140 are returned to the customer from the dispensing unit 120.

During dispensing when the store returns change to the customer, banknotes as the change are fed out one by one from the corresponding storage unit 160. The transport unit 150 transports the fed banknotes along the transport path, and discharges the banknotes to the dispensing unit 120.

FIG. 8 schematically shows the internal structure of the coin processing unit 300. As shown in FIG. 8, the coin processing unit 300 includes the depositing unit 310, the dispensing unit 320, the cassette 330, a recognition unit 340, a depositing transport unit 351, a dispensing transport unit 352, and a plurality of storage units 360 and chutes 370.

For example, the coin processing unit 300 includes eight storage units 360. As shown in FIG. 3, the store clerk can draw the coin processing unit 300 frontward from the front surface side of the money processing machine 1 to expose the components shown in FIG. 8 outside the housing of the money processing machine 1. For example, when a coin is jammed in a storage unit 360, a transport path of the depositing transport unit 351, or a transport path of the dispensing transport unit 352, the store clerk draws the coin processing unit 300 from the money processing machine 1 and removes the jammed coin.

During depositing when a customer pays cash to the store, the depositing unit 310 receives, in the inlet, coins paid by the customer. The coins in the depositing unit 310 are dropped into a feeding unit 380. The feeding unit 380 feeds out the coins received from the depositing unit 310 one by one to the transport path of the depositing transport unit 351. The depositing transport unit 351 transports the coins fed by the feeding unit 380 along the transport path. The recognition unit 340 recognizes and counts the coins transported along the transport path. The recognition unit 340 recognizes, for example, denomination, fitness, and authenticity of each coin. A plurality of chutes 370 are connected to the transport path downstream of the recognition unit 340. Although one chute 370 is indicated by a broken line in FIG. 8, the dispensing unit 320, the cassette 330, and the storage units 360 are respectively connected with chutes 370. Each chute 370 connects the transport path with any one of the dispensing unit 320, the cassette 330, and the storage units 360. Openings of the chutes 370 formed in the transport path are usually closed. The coins having passed through the recognition unit 340 are transported over the closed openings of the chutes 370 to the downstream side. When the opening of a chute 370 is opened according to the recognition result of a coin, the coin is dropped into the chute 370 through the opening. The dropped coin is sent to any of the dispensing unit 320, the cassette 330, and the storage units 360 through the chute 370.

The store clerk can previously set the kinds of coins to be stored in the respective storage units 360. For example, one or a plurality of denominations of coins to be stored are set on each storage unit 360. A coin which can be deposited is stored in the corresponding storage unit 360, according to the recognition result of the recognition unit 340. When the storage unit 360 corresponding to the coin is full, the coin is stored in the cassette 330. A coin which cannot be deposited is discharged to the dispensing unit 320 as a rejected coin. For example, a coin which cannot be recognized by the recognition unit 340 and a coin which is recognized as a counterfeit coin by the recognition unit 340 are returned to the customer from the dispensing unit 320.

During dispensing when the store returns change to the customer, coins as the change are fed out one by one from the corresponding storage unit 360. The fed coins are dropped on the transport path of the dispensing transport unit 352 disposed downstream of the storage unit 360. The dispensing transport unit 352 transports the coins received on the transport path, upward to the feeding unit 380. The feeding unit 380 opens an openable and closable gate formed at the bottom thereof to discharge the coins into the dispensing unit 320.

In the present embodiment, the power supply/communication unit 200 is disposed between the banknote processing unit 100 and the coin processing unit 300. However, arrangement of these units is not limited thereto. For example, the power supply/communication unit 200, the banknote processing unit 100, and the coin processing unit 300 may be disposed in this order from the top. Alternatively, the banknote processing unit 100, the coin processing unit 300, and the power supply/communication unit 200 may be disposed in this order from the top. Still alternatively, the banknote processing unit 100 or the coin processing unit 300 may include the power supply/communication unit 200. In this case, the banknote processing unit 100 and the coin processing unit 300 are aligned in the up-down direction, and the power supply/communication unit 200 is included in the banknote processing unit 100 or the coin processing unit 300.

In the present embodiment, the banknote processing unit 100 and the coin processing unit 300 are respectively moved by the slide rails 11, 13 disposed between the units 100, 300 and the housing of the money processing machine 1, and the power supply/communication unit 200 is moved over the support member 12 fixed to the money processing machine 1. However, the movement mode is not limited thereto. For example, like the power supply/communication unit 200, the banknote processing unit 100 and the coin processing unit 300 may be moved over the support member fixed to the housing of the money processing machine 1. Alternatively, like the banknote processing unit 100 and the coin processing unit 300, the power supply/communication unit 200 may be moved by a slide rail disposed between the unit 200 and the housing of the money processing machine 1.

In the present embodiment, the slide rail 11 is disposed between the banknote processing unit 100 and the money processing machine 1 to make the banknote processing unit 100 drawable from the housing of the money processing machine 1. Accordingly, with the banknote processing unit 100 being drawn out, the components thereof shown in FIG. 7 can be subjected to maintenance and/or inspection. However, the structure of the banknote processing unit 100 is not limited thereto. For example, a frame, which is drawable from a housing of the banknote processing unit 100, may be disposed in the housing, the components shown in FIG. 7 may be disposed on the frame, and the housing of the banknote processing unit 100 may be fixed in the housing of the money processing machine 1. In this case, the lock mechanism, which is locked and unlocked by using the keyhole 101 of the banknote processing unit 100, may be configured to lock the housing of the banknote processing unit 100 with the frame. When the lock mechanism is unlocked and the frame is drawn from the housing of the banknote processing unit 100, the components of the banknote processing unit 100 can be exposed outside the money processing machine 1. When fixation between the housing of the banknote processing unit 100 and the housing of the money processing machine 1 is released, the banknote processing unit 100 can be dismounted from the money processing machine 1. Also, the coin processing unit 300 is not necessarily drawable from the money processing machine 1. A housing of the coin processing unit 300 may be fixed in the money processing machine 1, and a frame on which the components shown in FIG. 8 are disposed may be drawn from the money processing machine 1. Furthermore, the coin processing unit 300 and the base unit 390 are not necessarily separately disposed, and the coin processing unit 300 may include the base unit 390.

Although the communication unit included in the power supply/communication unit 200 is connected to the banknote processing unit 100 and the coin processing unit 300 via the cables 201, 202, respectively, the manner of communication connection is not limited thereto. Likewise, although the communication unit included in the power supply/communication unit 200 is connected to the external device through the cable 203, the manner of communication connection is not limited thereto. For example, each communication connection may be implemented by using a wireless communication technology such as NFC (Near Field Communication) or Bluetooth (registered trademark) without using cables. In this case, the communication connections need not exclusively be either of wired connections or wireless connections. In other words, a combination of both wired connections and wireless connections may be employed. Specifically, among the communication connection between the communication unit of the power supply/communication unit 200 and the banknote processing unit 100, the communication connection between the communication unit of the power supply/communication unit 200 and the con processing unit 300, and the communication connection between the communication unit of the power supply/communication unit 200 and the external device, all the communication connections may be wired connections, or wireless connections. Alternatively, one or two communication connections may be wired connections while the remaining communication connections may be wireless connections. For example, the power supply/communication unit 200 in the money processing machine 1 may be connected via wires to the banknote processing unit 100 and the coin processing unit 300, while the money processing machine 1 may be wirelessly connected to the external device.

In the present embodiment, the banknote processing unit 100, the power supply/communication unit 200, and the coin processing unit 300 are drawable from the housing of the money processing machine 1. However, the power supply/communication unit 200 may be supported by the housing of the machine 1, and at least one of the banknote processing unit 100 and the coin processing unit 300 may be made drawable. For example, it is assumed that the banknote processing unit 100, the power supply/communication unit 200, and the coin processing unit 300 are vertically aligned in this order from the top. In this case, when the banknote processing unit 100 is drawn from the housing of the money processing machine 1, if the power supply unit and the communication unit are accessible from above the power supply/communication unit 200 (accommodation unit), a mechanism for drawing the power supply/communication unit 200 from the housing of the money processing machine 1 can be omitted. Likewise, when the coin processing unit 300 is drawn from the housing of the money processing machine 1, if the power supply unit and the communication unit are accessible from beneath the power supply/communication unit 200 (accommodation unit), a mechanism for drawing the power supply/communication unit 200 from the housing of the money processing machine 1 can be omitted.

In the present embodiment, as shown in FIG. 6, power is supplied from the outside of the money processing machine 1 to the power supply unit of the power supply/communication unit 200, and the power supply unit supplies power to the banknote processing unit 100 and the coin processing unit 300. However, the power supply method is not limited thereto. For example, one of the banknote processing unit 100 and the coin processing unit 300 may be supplied with power from the power supply unit of the power supply/communication unit 200, while the other one is supplied with power directly from the outside of the money processing machine 1. Specifically, for example, the control board of the banknote processing unit 100 may be supplied with power from the power supply/communication unit 200, while the control board of the coin processing unit 300 may be supplied with power through a power supply cable that is extended outward from the money processing machine 1 and plugged into a wall socket.

Although the examples of the structures of the banknote processing unit 100 and the coin processing unit 300 are shown in FIG. 7 and FIG. 8, respectively, the structures thereof are not limited thereto. For example, the coin processing unit 300 need not have the cassette 330. The structure of the banknote processing unit 100 is not particularly limited as long as it can perform depositing and dispensing of banknotes. The structure of the coin processing unit 300 is also not particularly limited as long as it can perform depositing and dispensing of coins. The banknote and coin processing methods in depositing and dispensing are also not limited to the methods described above. For example, only one denomination may be set on each of the storage units 160, 360. For example, if a storage unit 160 (360) is full and cannot receive money during depositing, money stored in the storage unit 160 (360) may be transferred to the cassette 130 (330) to make the storage unit able to store money, and thereafter, money may be stored in the storage unit 160 (360). For example, when feeding coins from the storage unit 360 during dispensing, the dispensing transport unit 352 may transport the coins directly to the dispensing unit 320 of the coin processing unit 300 without the intervening feeding unit 380.

In the present embodiment, the money processing machine is used for settlement of a transaction performed in a store. The machine includes: a banknote processing unit configured to perform depositing and dispensing of banknotes; a coin processing unit configured to perform depositing and dispensing of coins; and an accommodation unit configured to accommodate components to be connected to at least one of the banknote processing unit and the coin processing unit. The banknote processing unit, the coin processing unit, and the accommodation unit are disposed in a housing so as to be vertically aligned.

In the above configuration, the accommodation unit is disposed between the banknote processing unit and the coin processing unit.

In the above configuration, the banknote processing unit is disposed above the coin processing unit.

In the above configuration, a front surface of the banknote processing unit and a front surface of the accommodation unit are retracted rearward from a front surface of the coin processing unit.

In the above configuration, the banknote processing unit has a banknote inlet through which banknotes are deposited, and the coin processing unit has a coin inlet through which coins are deposited. The banknote inlet and the coin inlet are located such that at least parts thereof overlap each other when a positional relationship of the inlets in a width direction of the machine is considered in a plan view.

In the above configuration, the banknote processing unit further includes a banknote outlet through which banknotes are dispensed, and the coin processing unit further includes a coin outlet through which coins are dispensed. The banknote inlet, the banknote outlet, the coin inlet, and the coin outlet are located such that at least parts thereof overlap each other when a positional relationship of the inlets and outlets in the width direction of the machine is considered in a plan view.

In the above configuration, the banknote processing unit and the accommodation unit are disposed above the coin processing unit. A front surface of the banknote processing unit and a front surface of the accommodation unit are retracted rearward from a front surface of the coin processing unit. The coin inlet is disposed such that at least a part thereof is present at an upper surface of the coin processing unit.

In the above configuration, the banknote inlet is disposed such that at least a part thereof is present at a front surface of the banknote processing unit. The banknote outlet is disposed at the front surface of the banknote processing unit, and the coin outlet is disposed at the front surface of the coin processing unit.

In the above configuration, the banknote processing unit, the coin processing unit, and the accommodation unit are movable from a front surface side of the money processing machine, independently from each other.

In the above configuration, the accommodation unit accommodates a power supply unit for supplying power.

In the above configuration, the accommodation unit accommodates a communication unit for communicating with an external device.

In the above configuration, the banknote processing unit is connected to the power supply unit via a first cable. The first cable has a length that allows at least one of the banknote processing unit and the power supply unit to be moved toward the front surface of the money processing machine, while connecting the banknote processing unit with the power supply unit.

In the above configuration, the banknote processing unit is connected to the communication unit via the first cable. The first cable has a length that allows at least one of the banknote processing unit and the communication unit to be moved toward the front surface of the money processing machine, while connecting the banknote processing unit with the communication unit.

In the above configuration, the coin processing unit is connected to the power supply unit via a second cable. The second cable has a length that allows at least one of the coin processing unit and the power supply unit to be moved toward the front surface of the money processing machine, while connecting the coin processing unit with the power supply unit.

In the above configuration, the coin processing unit is connected to the communication unit via the second cable. The second cable has a length that allows at least one of the coin processing unit and the communication unit to be moved toward the front surface of the money processing machine, while connecting the coin processing unit with the communication unit.

In the above configuration, each of the first cable and the second cable is covered with a protection member.

As described above, the money processing machine 1 is a vertically-elongated small-sized machine having a height smaller than the average height of adults, and a width smaller than the height. Thus, the money processing machine 1 can be installed and used in a narrow space. For example, when a plurality of money processing machines 1 are installed side by side in a limited space in a store, a larger number of money processing machines 1 can be installed as compared to the conventional machines.

The money processing machine 1 includes the banknote processing unit 100, the power supply/communication unit 200, and the coin processing unit 300, each being unitized, and the respective units are movable frontward from the front surface side of the machine 1, independently from each other. In addition, the money processing machine 1 has the banknote inlet, the banknote outlet, the coin inlet, and the coin outlet at the front surface thereof. Thus, even when the money processing machine 1 is installed with the rear surface and the side surfaces thereof being close to a wall surface and/or another machine, banknotes and coins can be easily deposited and dispensed.

As described above, the money processing machine according to the present invention is useful when a small-sized money processing machine is required.

What is claimed is:

1. A money processing machine used for settlement of a transaction performed in a store, the machine comprising:

a banknote processing unit configured to perform depositing and dispensing of banknotes;

a coin processing unit configured to perform depositing and dispensing of coins; and an accommodation unit configured to accommodate components to be connected to at least one of the banknote processing unit or the coin processing unit, wherein the banknote processing unit, the coin processing unit, and the accommodation unit are disposed in a housing of the money processing machine so as to be vertically aligned, and the accommodation unit is disposed between the banknote processing unit and the coin processing unit, and the money processing machine is configured such that when the banknote processing unit or the coin processing unit is drawn from the housing, a unit disposed inside the accommodation unit is accessible from above or beneath the accommodation unit.

2. The money processing machine according to claim 1, wherein the banknote processing unit is disposed above the coin processing unit.

3. The money processing machine according to claim 1, wherein a height of the money processing machine is lower than 1250 mm and a width of the money processing machine is narrower than 300 mm.

4. The money processing machine according to claim 1, wherein positions of a front surface of the banknote processing unit and a front surface of the accommodation unit are retracted rearward positions from a front surface of the coin processing unit.

5. The money processing machine according to claim 1, wherein the banknote processing unit includes a banknote inlet through which banknotes are deposited, the coin processing unit has a coin inlet through which coins are deposited, and with regard to a positional relationship in a plan view in a width direction of the money processing machine, the banknote inlet and the coin inlet are located such that at least parts thereof overlap each other.

6. The money processing machine according to claim 5, wherein the banknote processing unit further includes a banknote outlet through which banknotes are dispensed, the coin processing unit further includes a coin outlet through which coins are dispensed, and with regard to a positional relationship in a plan view in a width direction of the machine, the banknote inlet, the banknote outlet, the coin inlet, and the coin outlet are located such that at least parts thereof overlap each other.

7. The money processing machine according to claim 6, wherein the banknote processing unit and the accommodation unit are disposed above the coin processing unit, positions of a front surface of the banknote processing unit and a front surface of the accommodation unit are retracted rearward positions from a front surface of the coin processing unit, and the coin inlet is disposed such that at least a part thereof is present at an upper surface of the coin processing unit.

8. The money processing machine according to claim 7, wherein the banknote outlet is disposed at the front surface of the banknote processing unit, and the coin outlet is disposed at the front surface of the coin processing unit.

9. The money processing machine according to claim 1, wherein the banknote processing unit, the coin processing unit, and the accommodation unit are movable from a front surface side of the money processing machine, independently from each other.

10. The money processing machine according to claim 1, wherein the accommodation unit accommodates a power supply unit for supplying power.

11. The money processing machine according to claim 10, wherein the accommodation unit accommodates a communication unit for communicating with an external device.

12. The money processing machine according to claim 11, wherein the banknote processing unit is connected to the power supply unit via a first cable, and the first cable has a length that allows at least one of the banknote processing unit or the power supply unit to be moved toward the front surface of the money processing machine, while connecting the banknote processing unit with the power supply unit.

13. The money processing machine according to claim 12, wherein the banknote processing unit is connected to the communication unit via the first cable, and the first cable has a length that allows at least one of the banknote processing unit or the communication unit to be moved toward the front surface of the money processing machine, while connecting the banknote processing unit with the communication unit.

14. The money processing machine according to claim 12, wherein the coin processing unit is connected to the power supply unit via a second cable, and the second cable has a length that allows at least one of the coin processing unit or the power supply unit to be moved toward the front surface of the money processing machine, while connecting the coin processing unit with the power supply unit.

15. The money processing machine according to claim 14, wherein the coin processing unit is connected to the communication unit via the second cable, and the second cable has a length that allows at least one of the coin processing unit or the communication unit to be moved toward the front surface of the money processing machine, while connecting the coin processing unit with the communication unit.

16. The money processing machine according to claim 14, wherein each of the first cable and the second cable is covered with a protection member.

17. The money processing machine according to claim 1, wherein the money processing machine is configured to be used by operating an operation unit arranged next to and separately from the money processing machine.

18. The money processing machine according to claim 1, wherein the money processing machine has a vertically-elongated shape having a height smaller than the average height of adults, and a width smaller than the height.

* * * * *